US008696238B2

(12) United States Patent
Rogan

(10) Patent No.: US 8,696,238 B2
(45) Date of Patent: Apr. 15, 2014

(54) EMULSION TACK COAT APPLICATOR AND METHODS THEREOF

(76) Inventor: David Rogan, Braintree, MA (US)

( * ) Notice: Subject to any disclaimer, the term of this patent is extended or adjusted under 35 U.S.C. 154(b) by 0 days.

(21) Appl. No.: 13/451,452

(22) Filed: Apr. 19, 2012

(65) Prior Publication Data

US 2013/0279981 A1 Oct. 24, 2013

(51) Int. Cl.
*E01C 19/12* (2006.01)

(52) U.S. Cl.
USPC ..... 404/111; 404/101; 404/107; 404/108

(58) Field of Classification Search
CPC ..... E01C 10/16
USPC ..... 404/111, 72, 75, 101, 107, 108
See application file for complete search history.

(56) References Cited

U.S. PATENT DOCUMENTS 3,989,403 A * 11/1976 Verive ..... 404/111
4,423,980 A * 1/1984 Warnock ..... 404/83
4,535,920 A * 8/1985 Troup ..... 222/612
4,575,279 A * 3/1986 Mateja ..... 404/111
4,653,424 A * 3/1987 Schloss et al. ..... 118/108
4,831,958 A * 5/1989 Selby ..... 118/108
5,735,952 A * 4/1998 Wilson, Sr. ..... 118/100
6,102,615 A * 8/2000 Wilson, Sr. ..... 404/111
6,290,428 B1 * 9/2001 Hall et al. ..... 404/75
7,641,420 B2 * 1/2010 Becker et al. ..... 404/107

* cited by examiner

*Primary Examiner* — Raymond W Addie
(74) *Attorney, Agent, or Firm* — Jon Fallon

(57) ABSTRACT

Embodiments of the present invention are generally related to an emulsion tack coat applicator and methods of utilizing the same. More specifically, embodiments of the present invention relate to hand truck-type applicator for emulsion tack coat applications and methods of using the same. In one embodiment of the present invention, a tack coat applicator comprising a hand truck comprising a substantially frame having a handle section at a first end and a set of wheels separated by an axle at a second end, and a platform extending substantially perpendicular to the rigid proximate the wheels; and bucket having a voluminous storage portion for storing tack coat material, removeably positioned on the platform, the bucket comprising an output for dispensing the tack coat material.

19 Claims, 5 Drawing Sheets

EMULSION TACK COAT APPLICATOR AND METHODS THEREOF

BACKGROUND

1. Field of the Invention

Embodiments of the present invention are generally related to an emulsion tack coat applicator and methods of utilizing the same. More specifically, embodiments of the present invention relate to hand truck-type applicator for emulsion tack coat applications and methods of using the same.

2. Description of Related Art

Tack coats are thin layers of asphalt product that are used in the construction or re-facing of roads, highways, sidewalks, driveways or the like. Tack coat is used to help the layers of asphalt laid down as part of the road building process to bond together with more efficiency, or bond with already existing asphalt. As a result, the highway or road is able to hold up under constant use for longer periods of time, making it easier to maintain the road properly. Without the presence of the tack coat, a new layer of asphalt laid upon an existing road would deteriorate much more quickly, often creating potholes and various conditions that decrease the safety of the road.

In order to achieve the highest degree of efficiency with a tack coat, it is important to prepare the section of road properly. The layer of asphalt that is already present should be dry and relatively free of dirt and other contaminants in order to facilitate a uniform application layer of the product and help the tack coat provide a greater bond with the asphalt.

In addition to the preparation of the asphalt, the nature of the application of the tack coat itself is greatly important. In larger applications, tack coat is applied to the asphalt using a large truck having a plurality of spray nozzles on the back thereof, evenly spaced across the width of the road. Often by dictating a nozzle spray rate of the tack coat, and speed of the truck, a proper calculation can be made for how large of a surface may be covered with the tack coat. Given the size of the trucks, the number of nozzles, etc., the surface area which is coated is usually quite substantial.

If someone needed to use tack coat on a small area, for example, fixing a patch on a driveway, the traditional large spray approach would not work effectively. Generally, for such small jobs, a laborer may use hand tools and apply the tack coat appropriately. For example, a laborer may utilize a bucket of tack coat, and use a cup or other voluminous container to collect a small portion of tack coat, and slowly pour it as needed. Often, someone may follow such process with a broom or brush, and smooth out the tack coat layer. In other known applications, hand spray devices may be utilized. However, such application may be extremely cumbersome and messy, and the spray applicator often gets clogged and jammed. As such, the tack coat on small jobs may often be skipped.

Thus, there is a need for a hand truck-type applicator for emulsion tack coat applications and methods of using the same.

SUMMARY

Embodiments of the present invention are generally related to an emulsion tack coat applicator and methods of utilizing the same. More specifically, embodiments of the present invention relate to hand truck-type applicator for emulsion tack coat applications and methods of using the same.

In one embodiment of the present invention, a tack coat applicator comprising a hand truck comprising a substantially frame having a handle section at a first end and a set of wheels separated by an axle at a second end, and a platform extending substantially perpendicular to the rigid proximate the wheels; and a bucket having a voluminous storage portion for storing tack coat material, removeably positioned on the platform, the bucket comprising an output for dispensing the tack coat material.

In another embodiment of the present invention, a tack coat applicator comprising a hand truck comprising a substantially frame having a handle section at a first end and a set of wheels separated by an axle at a second end, a platform extending substantially perpendicular to the rigid proximate the wheels, and a saddle portion having at least one support plate positioned parallel to the platform, having an aperture therethrough for supporting a bucket; and the bucket comprising a voluminous storage portion for storing tack coat material, removeably positioned on the platform, a handle, and an output having a valve and nozzle assembly, extending through a rear of the hand truck.

In yet another embodiment of the present invention, an emulsion tack coat applicator comprises: a hand truck comprising: a substantially frame having a handle section at a first end and a set of wheels separated by an axle at a second end; a platform extending substantially perpendicular to the rigid proximate the wheels; and a saddle portion having a plurality of support plates positioned parallel to the platform, each support plate having an aperture therethrough for supporting a bucket, and at least one support panel positioned between the plurality of support plates forming a sidewall; and the bucket, removeably positioned on the platform, comprising: a voluminous storage portion for storing tack coat material; a rotatable handle, removeably affixed to a cross bar of the hand truck via a spring link; and an output having a valve and nozzle assembly, extending through a rear of the hand truck; wherein the nozzle outputs the tack coat at an application rate of between about 0.02 gallons/yd$^2$ to about 0.30 gallons/yd$^2$.

BRIEF DESCRIPTION OF THE DRAWINGS

So the manner in which the above-recited features of the present invention can be understood in detail, a more particular description of embodiments of the present invention, briefly summarized above, may be had by reference to embodiments, which are illustrated in the appended drawings. It is to be noted, however, the appended drawings illustrate only typical embodiments of embodiments encompassed within the scope of the present invention, and, therefore, are not to be considered limiting, for the present invention may admit to other equally effective embodiments, wherein.

Figure 1:
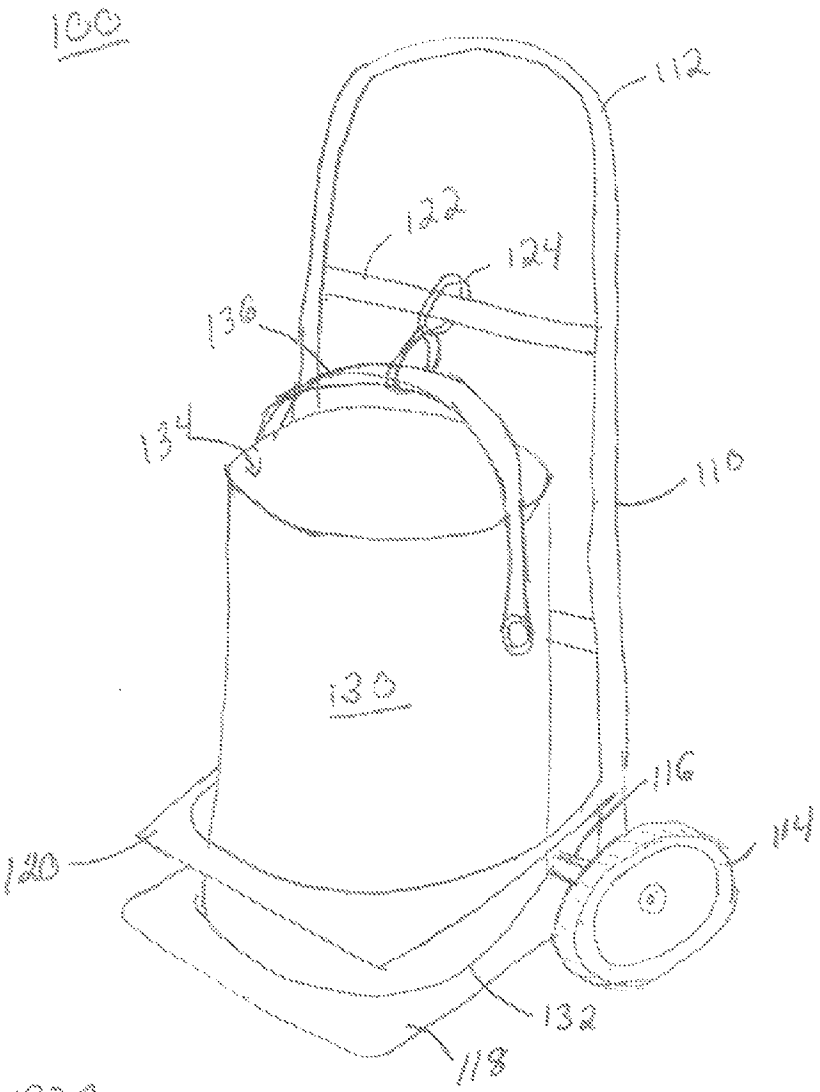
FIG. 1 depicts a front perspective view of an emulsion tack coat applicator in accordance with one embodiment of the present invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

Embodiments of the present invention are generally related to an emulsion tack coat applicator and methods of utilizing the same. More specifically, embodiments of the present invention relate to hand truck-type applicator for emulsion tack coat applications and methods of using the same.

Although embodiments of the present invention are described as being dedicated to tack coat applications, those of ordinary skill in the art may recognize equally suitable uses for embodiments of the present invention. As such, the systems and methods described herein should not be limited to the intended uses disclosed herein, but should be inclusive of alternative uses provided the novel features of embodiments of the present invention remain.

FIG. 1 depicts a front perspective view of an emulsion tack coat applicator in accordance with one embodiment of the present invention. Generally, the emulsion tack coat applicator comprises a hand truck 110 and a bucket 130 for storing tack coat. In accordance with embodiments of the present invention, the hand truck 110 comprises a substantially rigid frame having a handle section 112 at a distal end, a set of wheels 114 separated by an axle 116 at an opposing end, and a platform 118, extending substantially perpendicular to the rigid frame near the wheels 114. Although shown as being at a right angle to the frame, the platform 118 may be pitched at any angle suitable for embodiments of the present invention.

In many embodiments, the hand truck 110 further comprises a saddle portion for supporting the bucket 130, having at least one support plate 120. In some embodiments, multiple support plates 120 are provided, and are positioned vertically stacked on one another, having marginal spacing therein between, and having apertures therethrough for supporting a bucket. The support plate 120 may generally be affixed to a portion of the frame of the hand truck 110, and in many embodiments, may be welded or otherwise mechanically fastened thereto. The support plate 120 is often parallel to the platform 118, although such angle may vary depending on a particular application with an embodiment of the present invention. In some embodiments, a support panel (not shown) may be provided between multiple support plates 120, effectively forming one re more sidewalls, for additional support in the saddle portion.

In certain embodiments, where the frame of the hand truck 110 comprises two vertical posts joining at the handle section 112, the hand truck 110 further comprises at least one cross bar 122 for supporting the two vertical posts. The cross bar 122 may often be welded or otherwise mechanically affixed to the two vertical posts of the hand truck 110.

In many embodiments, the hand truck 110 and its components are manufactured from steel, or similar types of metal, with the exception of the wheels 114, which are often formed from a combination of metal and rubber, or other polymers. In certain embodiments, the components of the hand truck 110 are foldable and/or collapsible. For example, where each of the platform 118 and the support plate(s) 120 may be connected to the frame of the hand truck 110 via a hinge assembly, and may be folded and stored when not in use. Similarly, for example, each of the vertical posts of the frame may be telescopic and collapsible for storage when the applicator 100 is not in use.

The bucket 130 is generally used to store emulsified tack coat before it is applied to asphalt or the like. The bucket 130 comprises a substantially voluminous structure, capable of storing the tack coat. In many embodiments, the bucket 130 comprises a substantially cylindrical structure having a sidewall, a bottom surface 132 and a top opening 134. Optionally, in certain embodiments, a removable lid (not shown) may be provided over the top opening 134.

The bucket 130 also generally comprises a handle portion 136. The handle portion 136 may often comprise a protruding handle affixed to opposing sections of the sidewall of the bucket 130 and may be rotatable. In certain embodiments, the handle portion 136 comprises a cushion or ergonomic design, for convenience and comfort when a user lifts the bucket 130 out of, or puts a bucket 130 into, the applicator 100. For security, the bucket 130 may optionally secured against the hand truck 110 via a security means 124, for example, a spring link mechanism connecting the handle 136 to a cross bar 122 of the hand truck 110. In other embodiments, other mechanical connection devices, such as straps, claps, tie-downs, clips, or the like, may be utilized as a security means 124.

In many embodiments, the bucket 130 may comprise any materials suitable for embodiments of the present invention. In one embodiment, the bucket 130 comprises a metal structure, having a high strength to weight property. In another embodiment, the bucket 130 comprises an assembly of a pipe section (e.g., schedule 40 pipe) for the sidewalls, and a plate for the bottom surface 132. In certain embodiments, where a removable lid is provided, the materials may comprise pressure resistant materials, such that a pressure-controlled system (not shown) may be installed in conjunction with the interior volume of the bucket 130. Furthermore, in additional embodiments, the bucket 230 may be lined with a non-stick material, e.g., Teflon, to minimize the risk of having the tack coat stick therein.

When assembled, the bucket 130 is generally placed through the support plates 120 until the bottom surface 132 of the bucket 130 is resting on the platform 118. In one embodiment, the bucket 130 is resting against a first cross bar 122, and the handle 136 of the bucket 130 is securely connected to a second cross bar 122, as shown in the Figure, via a spring link 124 or similar mechanism.

Figure 2:
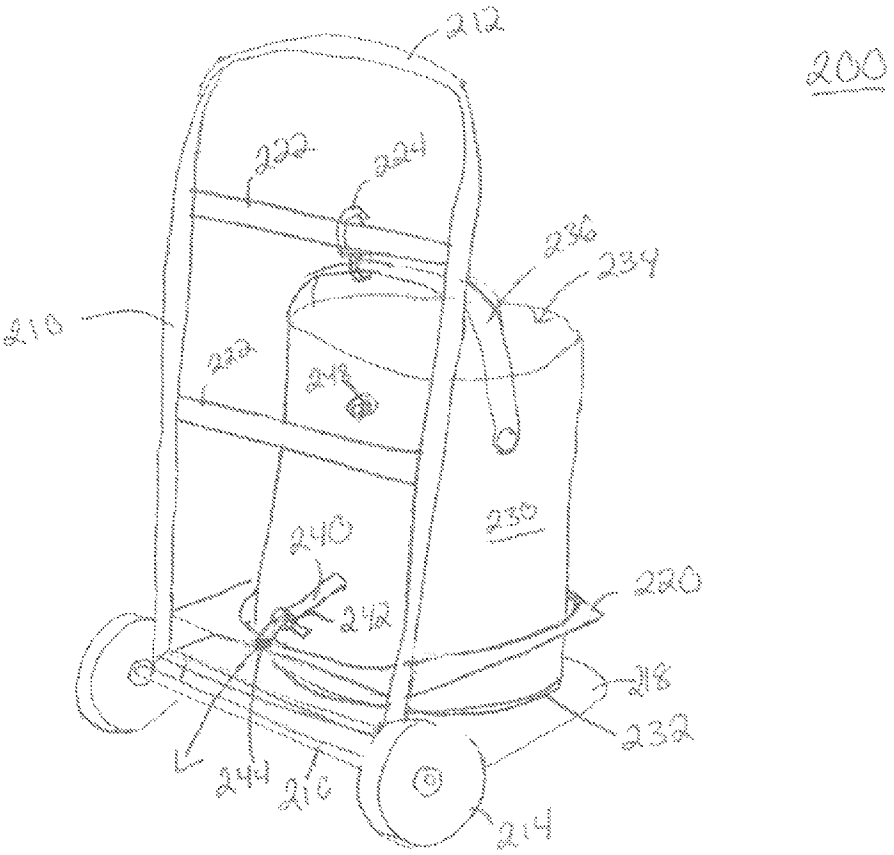
FIG. 2 depicts a rear perspective view of an emulsion tack coat applicator in accordance with one embodiment of the present invention.

FIG. 2 depicts a rear perspective view of an emulsion tack coat applicator in accordance with one embodiment of the present invention. The emulsion tack coat applicator 200 generally comprises a similar hand truck 210 and bucket 230 assembly as shown in FIG. 1. In FIG. 2, however, an output 240 is shown, extending from the bucket, through the frame of the hand truck 210. In many embodiments, the output 240 generally comprises at least a valve 242 and a nozzle 244. The valve 242 may comprise any type of valve suitable for embodiments of the present invention, allowing a user to at least open and close the output 240 and allow tack coat material to exit the bucket 230.

In many embodiments, the valve 242 comprises a type of two-port valve, such as a ball valve, having a handle extending on an outer surface thereof to allow for control. In such a valve, the handle may allow the valve to be either fully opened, fully closed, or a degree in between to regulate the flow rate of tack coat at the output 240. Alternative types of valves may be used, for example, in certain embodiments, any type of manual valve, such as a butterfly valve, globe valve, gate valve, diaphragm valve, or the like may be utilized. In other embodiments, where electronic control mechanisms (not shown) are provided, for example, on the handle section of the hand truck 110, other types of valves, such as pneumatic valves, solenoid valves, or the like, may be utilized for convenience.

The nozzle 244 may generally comprise any nozzle and/or diffuser suitable for embodiments of the present invention. The nozzle 244 is usually capable of spraying tack coat over a desired area at a desired flow rate. In many of such embodiments, the nozzle may be able to apply the tack coat between about 0.02 gallons/yd$^2$ to about 0.30 gallons/yd$^2$. In another embodiment, the nozzle may able to apply the tack coat between about 0.03 gallons/yd$^2$ to about 0.20 gallons/yd$^2$. As noted in the Figure, the nozzle 244 generally aims downward at an angle, e.g., 45 degrees, although such angle may vary depending on the application.

In many embodiments, the bucket 230 comprises a second port 248. Generally, the second port 248 may be utilized for any variety of purposes, including for example, placing another valve/nozzle assembly thereon and using it as a second output. In other embodiments, however, the second port 248 may be utilized as an input port, whereby hot emulsified tack coat can be put into the bucket 230 via the second port 248. In yet further embodiments the second port 248 may be utilized to help clean the bucket 230, by forcing a cleaning solution (e.g., water, oil, or the like) through the bucket and out the output 240.

In further embodiments, the second port 248 may be utilized with a pressurization system, as introduced supra, such that a constant pressure may be maintained within the bucket 230. For example, a pressurized air tank and gauge (not shown) may be assembled with the bucket 230 through the second port 248, and may maintain a constant high pressure in the bucket 230, to ensure constant flow rate out of the nozzle 244.

In certain embodiments, the second port 248 comprises a set of threads on the exterior wall of the bucket 230, but does not access the interior thereof. In such an embodiment, the second port 248 may be utilized to hold a cap or plug, or similar device, for blocking the nozzle or the like when the emulsion tack coat applicator 200 is not in use.

Figure 3A:
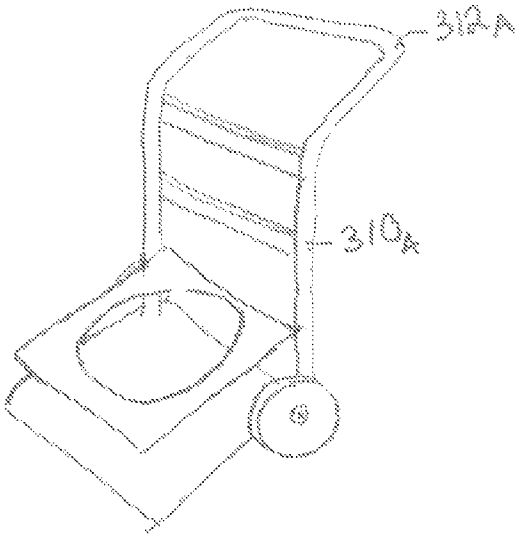
FIGS. 3A-3C depict varying embodiments of a hand cart design utilized with an emulsion tack coat applicator in accordance with embodiments of the present invention.
Figure 3B:
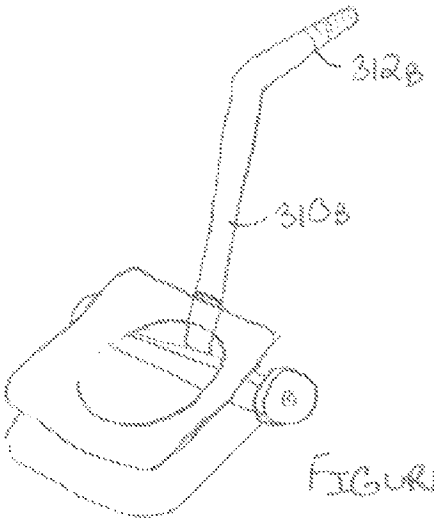
Figure 3C:
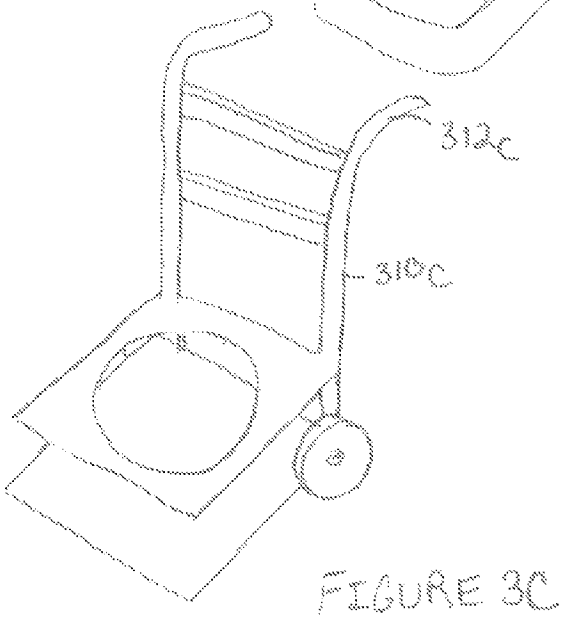

FIGS. 3A-3C depict varying embodiments of a hand cart design utilized with an emulsion tack coat applicator in accordance with embodiments of the present invention. As shown in the Figures, the hand truck assembly $\mathbf{310}_{A\text{-}C}$ may utilize a variety of styles of handles $\mathbf{312}_{A\text{-}C}$ to accommodate a variety of preferred methods of handling the same. For example, the handle $\mathbf{312}_A$ comprises a similar handle as those shown in FIGS. 1 and 2, however, it comprises a rearward bend allowing for a more ergonomic grip. The handle $\mathbf{312}_B$ is shown as a single handle, connected to a single vertical post. While such an embodiment may be more difficult to control with one hand, it may be useful for applications where the user has only one hand available to apply the tack coat. FIG. 3C depicts a handle $\mathbf{312}_C$ having generally similar structure to the handle $\mathbf{312}_A$ of FIG. 3A, however, by having two separate handle components, it may be more ergonomic for particular users.

Figure 4:
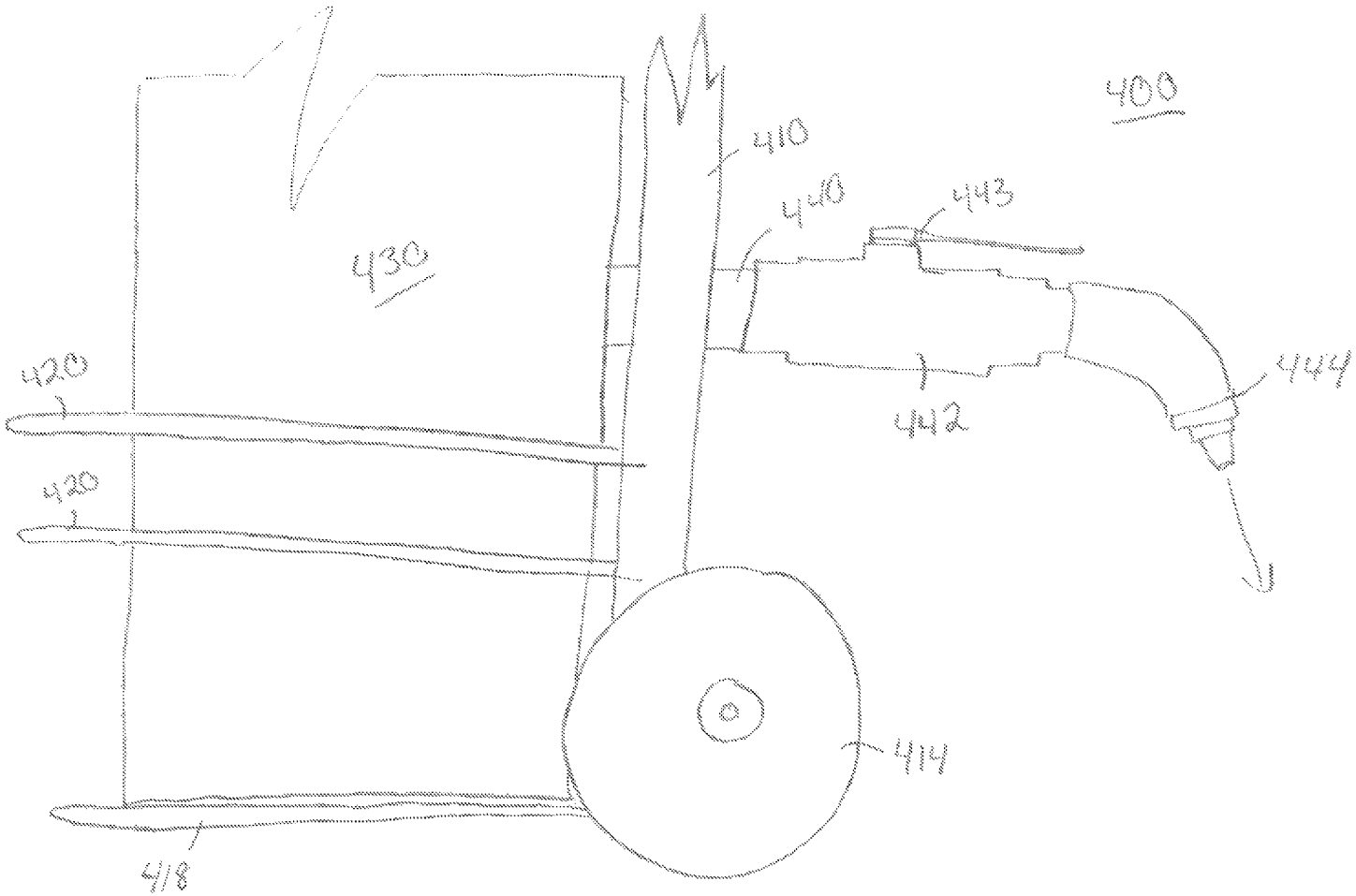
FIG. 4 depicts a side view of an emulsion tack coat applicator in accordance with one embodiment of the present invention.

FIG. 4 depicts a side view of an emulsion tack coat applicator in accordance with one embodiment of the present invention. Focusing on the lower half the applicator 400, the positioning of the output 440 in view of the hand truck 410 is shown. When the bucket is properly positioned, the output 440 extends through the back of the hand truck 410, and allows the nozzle 444 to sit out past the end of the wheels 414. Typically, the valve 442 will extend past the back of the hand truck 410 as well, such that its means for operation, e.g., handle 443, is accessible to the user. Once the valve 442 is open, the tack coat will begin to exit the bucket 430 via nozzle 444, as indicated by the directional arrow in the Figure.

It should be noted, however, during operation, the hand truck 410 will be slightly tipped back about the wheels 414, causing the platform 418 to lift off the ground. Accordingly, the angle of the flow direction as indicated in the Figure, may be slightly more vertical as the angle of the tip of the nozzle relative to the ground increases. For example, if the nozzle 444 is positioned at 45 degrees in a rested state, during operation, the nozzle 444 may likely be positioned at 45 degree plus the angle of degree of rotation of the hand truck 410 about its wheels 414.

Figure 5:
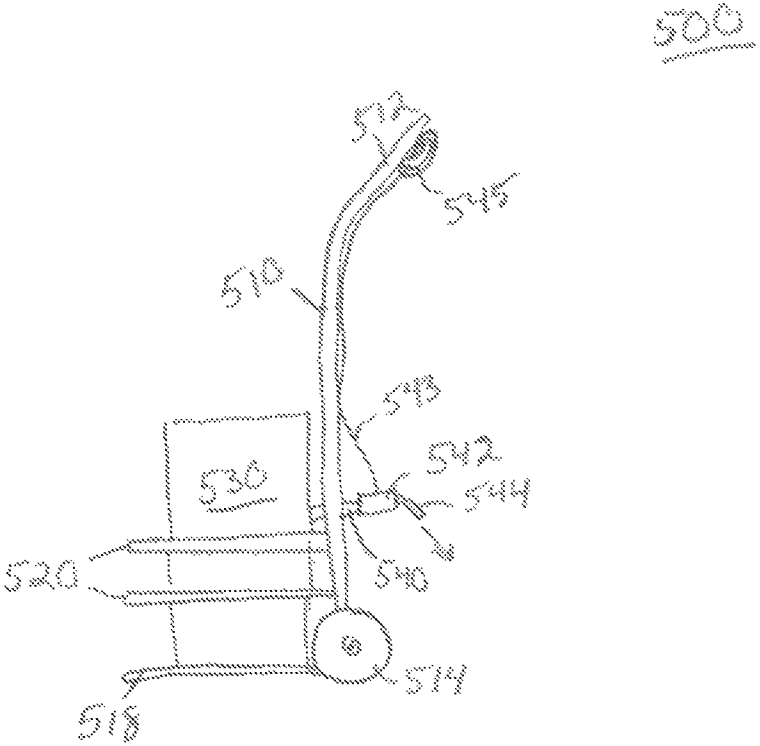
FIG. 5 depicts another side view of an emulsion tack coat applicator in accordance with an alternative embodiment of the present invention.

FIG. 5 depicts another side view of an emulsion tack coat applicator in accordance with an alternative embodiment of the present invention. As shown in the Figure, the tack coat applicator 500 is substantially similar to those discussed hereinabove, however, in the embodiment shown, the valve 542 may be provided with a pneumatic or electronic control mechanism that may be controlled at the handle 512. For example, in one embodiment, the valve 542 is an electromechanical valve, such as a solenoid valve. In such an embodiment, the valve 542 may be controlled via a control device 545 or trigger, which is in communication with the valve 542 via a cable or wire 543. Thus, the flow rate of the valve 542 and nozzle 544 may be controlled during operation, allowing for more accuracy in spraying the appropriate amount of tack coat.

Alternatively, in certain embodiments, a motor (not shown) may be provided in communication with the wheels 514, similar to a walk-assisted lawnmower, having a control mechanism/trigger, similar to that described above. In such embodiments, by controlling the flow rate of the nozzle 544 and the speed of rotation of the wheels 514 electronically, the application of the tack coat is likely to be substantially more uniform during the application process.

In some further embodiments of the present invention, while the bucket may be limited in size, the bucket may optionally be in communication with a hose or other means for supplying additional tack coat to the interior of the bucket. For example, in some embodiments, the bucket may have another input (or may use the second port) for receiving a constant supply of tack coat from a truck or other supply means. As such, for larger jobs, the user may not likely need to stop to refill the bucket.

In operation, the tack coat applicator may apply a substantially uniform coat of tack coat material over a specific area. Once the valve is open, a user may slightly tilt the hand truck back about its wheels, such that the platform lifts off the ground. From there, the user may being to walk in the direction of the nozzle, and apply the tack coat over the desired surface, typically at the intersection of old and new asphalt. By having complete control over the maneuvering of the tack coat applicator, the user may easily manipulate awkward areas, intersection lines, and the like, while minimizing the likelihood of needing to touch up the tack coat with a brush or other hand tool.

While the foregoing is directed to embodiments of the present invention, other and further embodiments of the invention may be devised without departing from the basic scope thereof. It is also understood that various embodiments described herein may be utilized in combination with any other embodiment described, without departing from the scope contained herein. In addition, embodiments of the present invention are further scalable, as particular applications may require.

What is claimed is:

1. A tack coat applicator comprising:

a hand truck comprising a substantially rigid frame having a handle section at a first end and a set of wheels separated by an axle at a second end, and a platform extending substantially perpendicular to the rigid frame proximate the wheels;

a bucket disposed against the hand truck frame, the bucket having a rear sidewall substantially parallel to the frame between the set of wheels and the handle section, the bucket having a voluminous storage portion for storing tack coat material, removeably positioned on the platform, the bucket comprising an output in the rear sidewall of the bucket for dispensing the tack coat material, the output comprising a valve and nozzle assembly extending from the rear sidewall of the bucket through a rear of the hand truck, the output positioned between an operator and the bucket; and whereby applying a pulling force on the tack coat applicator allows the operator to be positioned ahead of the output to avoid stepping in or around applied tack coat material, reducing operator fatigue and tack coat smudge.

2. The tack coat applicator of claim 1, wherein the valve comprises one of a ball valve, a butterfly valve, globe valve, gate valve, diaphragm valve, a pneumatic valve, a solenoid valve, or combinations thereof.

3. The tack coat applicator of claim 1, wherein the nozzle outputs the tack coat at an application rate of between about 0.02 gallons/yd$^2$ to about 0.30 gallons/yd$^2$.

4. The tack coat applicator of claim 3, wherein the nozzle outputs the tack coat at an application rate of between about 0.03 gallons/yd$^2$ to about 0.20 gallons/yd$^2$.

5. The tack coat applicator of claim 1, wherein the hand truck further comprises a saddle portion having at least one support plate positioned parallel to the platform, the support plate having an aperture therethrough for supporting the bucket.

6. The tack coat applicator of claim 5, wherein the saddle portion comprises at least a plurality of support plates.

7. The tack coat applicator of claim 1, wherein the bucket further comprises a handle.

8. The tack coat applicator of claim 7, wherein the handle is removeably affixed to a cross bar of the hand truck via a spring link.

9. The tack coat applicator of claim 1, wherein the bucket further comprises a removable lid.

10. The tack coat applicator of claim 1, wherein the bucket further comprises a second port for access to the voluminous storage portion therein.

11. A tack coat applicator comprising:

a hand truck comprising a substantially rigid frame having a handle section at a first end and a set of wheels separated by an axle at a second end, a platform extending substantially perpendicular to the rigid frame proximate the wheels, and a saddle portion having at least one support plate positioned parallel to the platform, having an aperture therethrough for supporting a bucket;

the bucket disposed against the hand truck frame, the bucket having a rear sidewall substantially parallel to the frame between the set of wheels and the handle section, the bucket comprising a voluminous storage portion for storing tack coat material, removeably positioned on the platform, a handle, and an output in the rear sidewall of the bucket, the output comprising a valve and nozzle assembly extending from the rear sidewall of the bucket through a rear of the hand truck, the output positioned between an operator and the bucket; and whereby applying a pulling force on the tack coat applicator allows the operator to be positioned ahead of the output to avoid stepping in or around applied tack coat material, reducing operator fatigue and tack coat smudge.

12. The tack coat applicator of claim 11, wherein the nozzle outputs the tack coat at an application rate of between about 0.02 gallons/yd$^2$ to about 0.30 gallons/yd$^2$.

13. The tack coat applicator of claim 12, wherein the nozzle outputs the tack coat at an application rate of between about 0.03 gallons/yd$^2$ to about 0.20 gallons/yd$^2$.

14. The tack coat applicator of claim 11, wherein the saddle portion comprises at least a plurality of support plates.

15. The tack coat applicator of claim 11, wherein the handle is removeably affixed to a cross bar of the hand truck via a spring link.

16. The tack coat applicator of claim 11, wherein the bucket further comprises a removable lid.

17. The tack coat applicator of claim 16, wherein the bucket further comprises a second port for access to the voluminous storage portion therein.

18. The tack coat applicator of claim 17, further comprising a pressurized control system for maintaining substantially constant pressure within the voluminous storage portion of the bucket via the second port.

19. An emulsion tack coat applicator comprising:

a hand truck comprising:

a substantially frame having a handle section at a first end and a set of wheels separated by an axle at a second end;

a platform extending substantially perpendicular to the rigid proximate the wheels; and a saddle portion having a plurality of support plates positioned parallel to the platform, each support plate having an aperture therethrough for supporting a bucket disposed against the hand truck frame, the bucket having a rear sidewall substantially parallel to the frame between the set of wheels and the handle section, the bucket, and at least one support panel positioned between the plurality of support plates forming a sidewall; and the bucket, removeably positioned on the platform, comprising:

a voluminous storage portion for storing tack coat material;

a rotatable handle, removeably affixed to a cross bar of the hand truck via a spring link; and an output in the rear sidewall of the bucket, the output comprising a valve and nozzle assembly extending from the rear sidewall of the bucket through a rear of the hand truck, wherein the nozzle outputs the tack coat at an application rate of between about 0.02 gallons/yd$^2$ to about 0.30 gallons/yd$^2$, the output positioned between an operator and the bucket; and whereby applying a pulling force on the tack coat applicator allows the operator to be positioned ahead of the output to avoid stepping in or around applied tack coat material, reducing operator fatigue and tack coat smudge.

* * * * *